United States Patent [19]

Curry

[11] 3,934,744

[45] Jan. 27, 1976

[54] CLOSURE ASSEMBLY

[75] Inventor: John Joseph Curry, Westchester, Ill.

[73] Assignee: Illinois Tool Works Inc., Chicago, Ill.

[22] Filed: Oct. 3, 1974

[21] Appl. No.: 511,904

[52] U.S. Cl. ..... 215/219

[51] Int. Cl.[2] ..... B65D 55/02; B65D 85/56; A61H 1/00

[58] Field of Search ..... 215/9, 219, 220

[56] References Cited

UNITED STATES PATENTS

| | | | |
|---|---|---|---|
| 3,027,035 | 3/1962 | Farago | 215/219 |
| 3,822,805 | 7/1974 | Marchant | 215/9 |
| 3,848,761 | 11/1974 | Lilit | 215/220 |
| 3,892,325 | 7/1975 | Maguire | 215/219 |

*Primary Examiner*—George T. Hall
*Attorney, Agent, or Firm*—E. L. Benno; R. W. Beart

[57] ABSTRACT

An outer cap for association with a conventional externally knurled screw closure cap and serving as a safety overcap converting the same to a double cap safety closure for sealing threaded bottles and other containers with contents which might be harmful to children; with the outer cap constructed for trapped association with the inner cap for permissive free rotation relative thereto but provided with internal knurling and an adjacent relieved or slotted area permitting inward flexing of the adjacent knurled wall of the overcap into engagement with the external knurling of the inner cap upon selected pressure applied by an adult to effect rotation of both caps in unison, such as the unscrewing direction, for authorized access to the contents of the container.

4 Claims, 4 Drawing Figures

CLOSURE ASSEMBLY

The present invention is concerned with a safety overcap which may be applied to standard or conventional externally knurled screw closures as a complete safety closure assembly for cappind machinery but which may be supplied separately to pharmacies and other establishments which generally have a stock of bottles and conventional screw caps for dispensing products. In such situations, where a dangerous drug or other product or ingredient is to be dispensed, the pharmacist may snap the safety overcap on the screw cap of the filled container before delivery to the customer.

In the prior art, there are many forms of safety closures designed to prevent or render it difficult for children to remove the same from bottles and the like containing medicines or other contents which might be harmful without supervision. There are those requiring implements for removing the closures and those requiring some undisclosed, and not readily apparent manipulation of the closure before it can be removed or unscrewed from the associated container, and various other types. Among those requiring some manipulation of the closure, there is the type including an inner cap for threaded engagement with a container and an overcap which will rotate relative to the inner cap in counterclockwise unscrewing direction but which may be manipulated by an adult to effect interengagement between the two caps for opening rotation of the closure assembly. This interengagement between the two caps may be accomplished by some axial movement of the overcap relative to the inner cap or by a radial squeezing pressure application of force to selected portions of the overcap. It is the latter type to which the present invention is directed.

An object of the present invention is to provide a safety overcap for association with a conventional externally knurled screw cap of plastic or metal and converting the same to a double cap safety closure assembly preventing or rendering it difficult for children to remove the same from bottles or other containers.

Another object of the invention is to provide such an overcap with internal knurling on the skirt, as at opposed areas, and with weakened or relieved areas adjacent the internal knurling permitting adult application of radial pressure to flex the internally knurled areas into engagement with the external knurling of the associated screw closure for rotating both caps in either opening or closing directions.

The above and other objects of the invention will in part be obvious and will be hereinafter more fully pointed out in the following detailed description of the drawings in which FIG. 1 is an exploded perspective view of the overcap, a conventional screw closure, and the threaded neck of a bottle;

Figure 1:
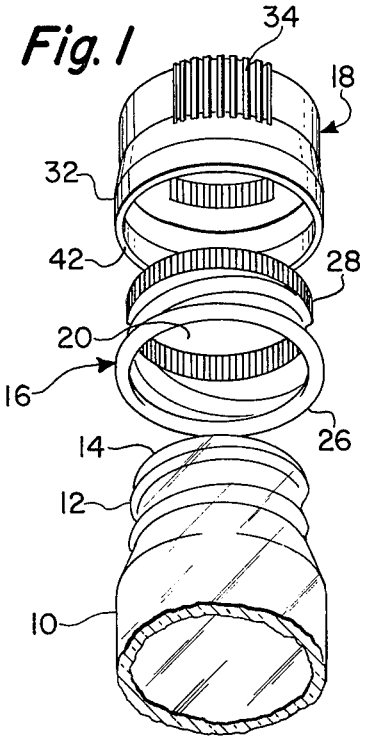
Figure 2:
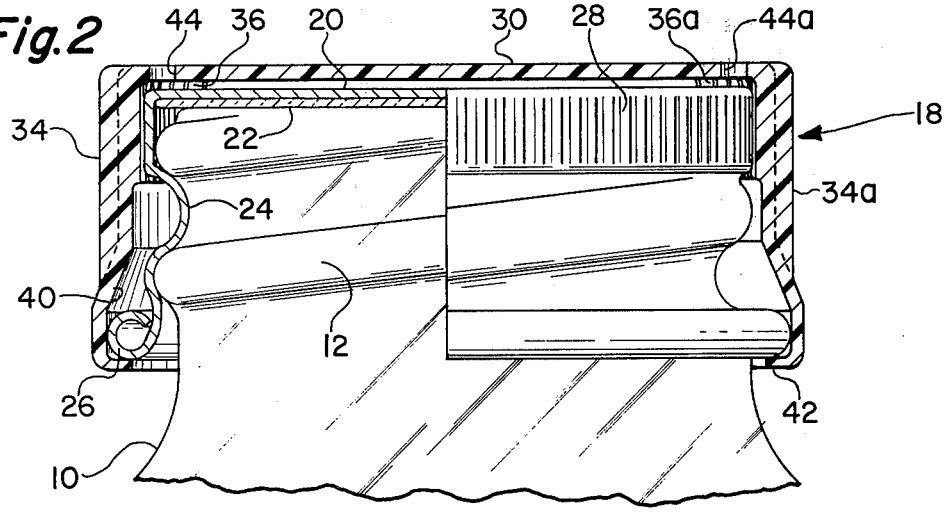
FIG. 2 is an enlarged side view of the parts of FIG. 1 assembled with the overcap in complete vertical section and with the inner screw closure in partial vertical section.

With reference to FIG. 1, there are shown, in separated fashion, a conventional bottle 10 with thread convolutions 12 along the neck which terminates in a top finish or lip 14; a conventional or standard screw closure cap 16, and the overcap 18. The screw closure cap may be of relatively rigid plastic material, such as polypropylene, with a top closing wall and a depending skirt with internal threads and external vertical knurling or ribs. However, the screw closure cap 16 is illustrated as being of sheet metal having a top closing wall 20 carrying a sealing disc 22 (FIG. 2) and a depending threaded skirt 24 terminating in an outward bead 26, and having external knurling or vertical ribs 28 around the upper external periphery thereof. With the overcap 18 removed from the showing of FIG. 2, the bottle 10 and conventional screw cap 16 constitute a normal assembly for dispensing to customers from drug stores and other retail outlets. The conversion of such an assembly to a double cap safety closure is accomplished by its association with the overcap 18 as in FIG. 4 and which will be described below.

Figure 3:
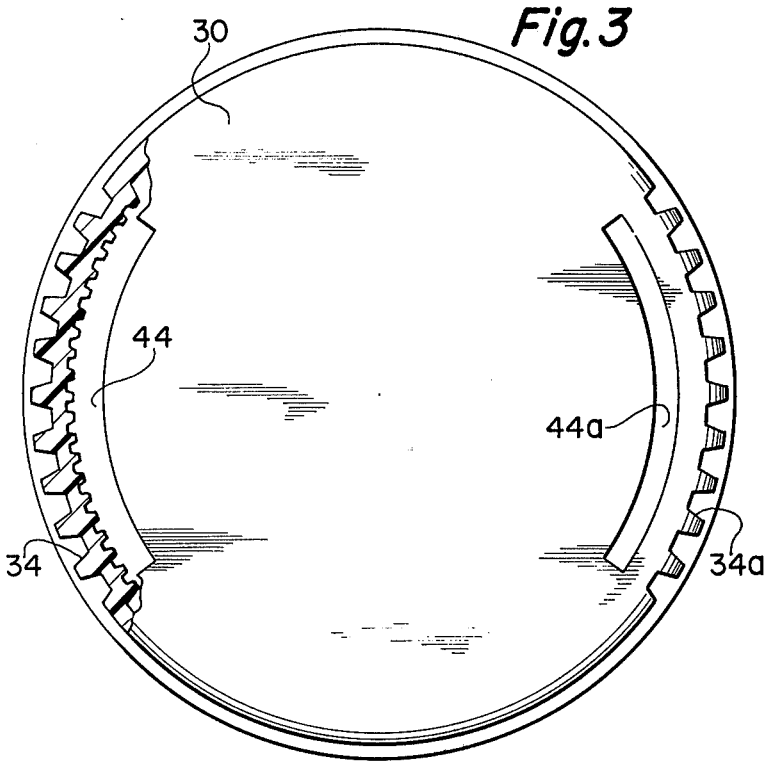
FIG. 3 is an enlarged top view of the overcap in partial transverse section.
Figure 4:
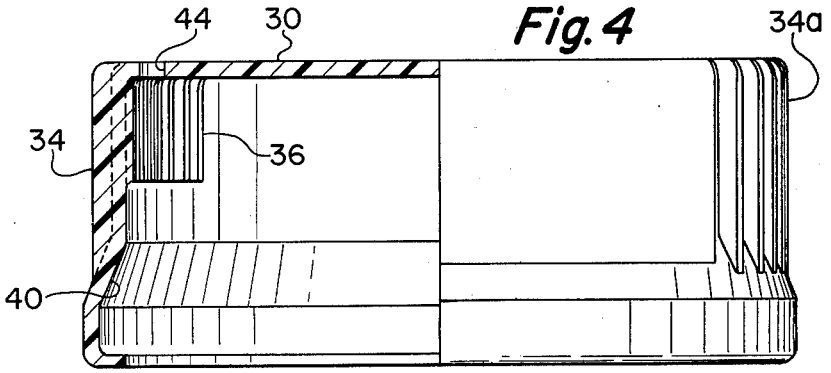
FIG. 4 is a side view of FIG. 3 in partial vertical section.

With reference to FIGS. 3 and 4, the overcap 18 includes a top wall 30 and a depending skirt 32, both to overlie the top wall and depending skirt, respectively, of the inner screw cap when assembled therewith for conversion. The skirt 32 is illustrated as having diametrically opposed external knurled or vertically ribbed areas 34, 34*a* for finger gripping although this knurling may be continuous around the periphery, if desired, for more conventional appearance. The interior surface of the skirt 32 is provided with similarly located areas of knurling or reduced size ribbing 36 normally spaced for clearance from the knurling 28 on the inner screw cap so that the outer cap can rotate freely relative to the inner cap and normally prevent unscrewing of the inner cap from the container. The lower edge portion of the skirt 32 is flared outwardly, as at 40, to overlie the bead 26 and is then turned inwardly to provide a trapping flange 42 underlying the bead 26 for snap assembly of the overcap with the inner screw cap, the overcap being formed of suitable metal or plastic, as polyethylene, of sufficient resiliency or reduced thickness in this area to permit the flange 42 to snap by the head 26 for assembly purposes, and with the inner surface of the skirt 32 adjacent the bead 26 contacting the same to maintain the outward spacing of the knurling 36 from the knurling 28 on the screw cap. The overcap 18 is provided with areas of weakness in a wall portion generally coextensive with and adjacent to the ribbed areas 36 or at diametrically opposed portions thereof where the same might be continuous around the inner periphery of the skirt 32. Such area or areas of weakness are for the purpose of giving flexibility to the adjacent knurled area permitting bodily movement thereof inwardly under applied force by an adult to bring that knurling into engagement with the knurling 28 on the inner screw cap for rotation thereof in opening and closing the container. As illustrated, the top wall 30 is provided with arcuate slots 44, 44*a* which break the continuity of connection between the top wall 30 and the skirt 32, thus providing flexibility for that portion of the skirt to be urged inwardly by adult finger pressure applied radially thereon, that is, on the ribs 34, 34*a*. This will cause the knurling 36 to be urged inwardly into engagement with ribbing or knurling 28 on the inner screw cap so that both caps can be removed from or applied to the container by rotation in unison. Otherwise the remaining portions of the skirt 32 are of sufficient rigidity to resist any inward pressure applied thereto in efforts to open the container. This inward bending of the knurled skirt portions 34, 34*a* need be only very slight where the spacing of the knurling 36 and 28 is also very slight but the resistance to such inward movement is controlled by selection of material characteristics which tend to prevent such movement under efforts of children attempting to open the container. The extent of the arcuate slots is also selected to resist such inward movement of the skirt by finger pressure of children. The areas of relief or weakness provided by the slots 44, 44*a* for flexibility may also be provided by slots transversely through the ribbed portions 34, 34*a* or by reduced thickness of cap material at the locations of slots 44, 44*a* so that such areas of reduced thickness may yield, as by buckling, for the intended purpose.

I claim:

1. An outer cap for association as a safety overcap for a standard metal closure cap of the type having a relatively flat top wall and a depending skirt with knurling on the upper edge portion of said skirt and with threads in said skirt below said knurling and with an outwardly rolled rim at the lower edge portion of said skirt for threading of said closure cap onto complementary thread-like formations on a container neck portion for closing the same, said outer cap being formed of a resilient plastic material and comprising a top wall to overlie the top wall of the closure cap and a depending skirt of sufficient height to completely encircle the skirt of the closure cap, and a radially inwardly extending flange integrally formed on the lower edge of said depending skirt of said outer cap for trapping the outer cap on the closure cap, the upper portion of the inner wall of said skirt of said outer cap having a diameter larger than the diameter of a circle through the tips of said knurling on said closure cap, said upper portion of said inner wall of said skirt of said cap having two integrally formed teeth segments which are diametrically disposed to each other, the tips of said teeth segments lying on a circle of a diameter greater than the diameter of said circle through the tips of said knurling on said closure cap, the top wall of said outer cap being formed to have two arcuate slots therethrough which are diametrically disposed to each other and immediately radially inwardly of said two teeth segments and in substantially circumferential alignment with said two teeth segments, and said teeth segments having tooth profiles capable of mechanically interlocking with said knurling on said closure cap when said outer cap is mounted on said closure cap and a person squeezes opposed upper outer wall portions of said skirt of said outer cap radially outwardly of said teeth segments.

2. The outer cap as claimed in claim 1, wherein said opposed upper outer wall portions of said skirt of said outer cap radially outwardly of said teeth segments are provided with vertical rib means formed for finger gripping support in manipulating the outer cap.

3. A safety closure assembly for a container having a threaded container lip, said assembly comprising a metal closure cap having a relatively flat top wall and a depending skirt, said depending skirt of said closure cap being formed to have knurling about the upper edge portion of said skirt, and threads formed in said skirt below said knurling and with an outwardly rolled rim at the lower edge portion of said skirt, said knurling permitting said closure cap to be threaded over said container lip to seal said container, an outer cap formed of a resilient plastic material and comprising a top wall superposed on said top wall of said closure cap and a depending skirt completely encircling the skirt of said closure cap, a radially inwardly extending flange integrally formed on the lower edge of said depending skirt of said outer cap to trap said outer cap on said closure cap, the upper portion of the inner wall of said skirt of said outer cap having a diameter larger than the diameter of a circle through the tips of said knurling on said closure cap, said upper portion of said inner wall of said skirt of said outer cap having two integrally formed teeth segments which are diametrically disposed to each other, the tips of said teeth segments lying on a circle of a diameter greater than the diameter of said circle through the tips of said knurling on said closure cap, the top wall of said outer cap being formed to have two arcuate slots therethrough which are diametrically disposed to each other and immediately radially inwardly of said two tip segments and in substantially circumferential alignment with said two teeth segments and said teeth segments having tooth profiles capable of mechanically interlocking with said knurling on said closure cap when a person squeezes opposed upper outer wall portions of said skirt of said outer cap radially outwardly of said teeth segments.

4. A safety closure assembly as defined in claim 3, wherein said opposed upper outer wall portions of said skirt of said outer cap radially outwardly of said teeth segments are provided with vertical ribs for finger gripping support in manipulating the outer cap.

* * * * *